US010231520B2

(12) United States Patent
Kudronowicz

(10) Patent No.: US 10,231,520 B2
(45) Date of Patent: Mar. 19, 2019

(54) WALKER GLIDE

(71) Applicant: Vamp Medical Rehab and Design, LLC, Eagle, WI (US)

(72) Inventor: Jay Kudronowicz, Eagle, WI (US)

(73) Assignee: Vamp Medical Rehab & Design, LLC, Eagle, WI (US)

( * ) Notice: Subject to any disclaimer, the term of this patent is extended or adjusted under 35 U.S.C. 154(b) by 0 days.

(21) Appl. No.: 15/852,698

(22) Filed: Dec. 22, 2017

(65) Prior Publication Data

US 2018/0242700 A1 Aug. 30, 2018

Related U.S. Application Data

(60) Provisional application No. 62/463,464, filed on Feb. 24, 2017.

(51) Int. Cl.

| | |
|---|---|
| ***A45B 9/04*** | (2006.01) |
| ***A61H 3/02*** | (2006.01) |
| ***A47B 91/06*** | (2006.01) |
| *A61H 3/04* | (2006.01) |

(52) U.S. Cl.

CPC ..... *A45B 9/04* (2013.01); *A47B 91/06* (2013.01); *A61H 3/0288* (2013.01); *A61H 3/04* (2013.01)

(58) Field of Classification Search

CPC ..... A45B 9/04; A47B 91/06; A47B 91/12; A61H 3/0288

See application file for complete search history.

(56) References Cited

U.S. PATENT DOCUMENTS

| | | | | |
|---|---|---|---|---|
| 1,921,561 A * | 8/1933 | Burton | A47B 91/04 | 16/42 R |
| 5,191,676 A * | 3/1993 | Gerner | A47B 91/06 | 16/42 R |
| 5,301,703 A * | 4/1994 | Kahn | A45B 9/04 | 135/77 |
| 5,485,862 A * | 1/1996 | Kahn | A45B 9/04 | 135/77 |
| 5,911,235 A * | 6/1999 | Henderson | B60B 33/0052 | 135/85 |
| 6,418,951 B1 * | 7/2002 | Douglass | A61H 3/00 | 135/67 |
| 7,516,513 B1 * | 4/2009 | Powell | A47B 91/06 | 16/42 R |
| 7,637,274 B1 * | 12/2009 | Dodson | A61H 3/0277 | 135/84 |
| 7,882,848 B2 | 2/2011 | Diamond | | |
| 8,671,962 B1 * | 3/2014 | Dodson | A45B 9/04 | 135/84 |

(Continued)

FOREIGN PATENT DOCUMENTS

FR 2668690 A1 * 5/1992 ..... A45B 9/04

OTHER PUBLICATIONS

English translation of FR 2,668,690 from espacenet.com.*

*Primary Examiner* — David R Dunn
*Assistant Examiner* — Danielle Jackson
(74) *Attorney, Agent, or Firm* — Smith Keane LP

(57) ABSTRACT

A durable walker glide that is configured to be placed on the rear legs of a 2-wheeled walker to allow smooth gliding along flooring surfaces in all directions. The walker glide has a housing and a base shoe removably affixed to the housing via friction. The housing can be wrapped in a plastic sleeve having a design or text.

10 Claims, 8 Drawing Sheets

(56) References Cited

U.S. PATENT DOCUMENTS

| | | | | |
|---|---|---|---|---|
| 8,739,807 | B2 * | 6/2014 | Taylor | A61H 3/0288 135/77 |
| 2003/0019419 | A1 * | 1/2003 | Ford | A61H 3/0288 116/208 |
| 2006/0272691 | A1 * | 12/2006 | DeLesline | A61H 3/0288 135/67 |
| 2007/0204430 | A1 * | 9/2007 | Chase | A47B 91/06 16/42 R |
| 2008/0191106 | A1 * | 8/2008 | Shiffler | A47B 91/06 248/188.9 |
| 2008/0244870 | A1 * | 10/2008 | Chase | A47B 91/06 16/42 R |
| 2009/0078296 | A1 * | 3/2009 | Diamond | A61H 3/04 135/86 |
| 2009/0308420 | A1 * | 12/2009 | Galanty | A45B 9/04 135/86 |
| 2010/0071166 | A1 * | 3/2010 | Klugh | A61H 3/0288 16/42 R |
| 2010/0212114 | A1 * | 8/2010 | Carpinella | A47B 91/06 16/42 T |
| 2017/0312164 | A1 * | 11/2017 | Dollarhide | A45B 3/04 |

* cited by examiner

WALKER GLIDE

RELATED APPLICATIONS

This application claims the benefit of U.S. Provisional Patent Application Ser. No. 62/463,464, filed 24 Feb. 2017, and titled "Spherical Walker Glide," which is incorporated herein by reference in its entirety.

BACKGROUND OF THE INVENTION

Persons of limited mobility have long relied on walking assistance provided by devices called "Walkers." A Walker generally has four legs (two front and two rear) and a pair of handles and allows a person to shift the support of his or her weight from his or her legs to the Walker when moving about. Typically, the legs of the Walker have rubber feet at the ends of the two rear legs and wheels at the ends of the two front legs which make contact with the ground. The rubber feet, however, have a tendency to limit the ability of the Walker to slide the rear legs along the ground.

One prior art embodiment directed towards increasing the sliding ability of the rear legs included removing the rubber feet from the Walker and installing tennis balls in replacement thereof. However, this required a potentially dangerous operation for healthcare staff when they attempt to cut holes in the tennis balls to fit on the Walker's legs. Also, the Tennis balls tended to wear out quickly from friction with the floor surface.

Another prior art embodiment includes installing "Walker Ski Glides" like those sold by Drive Medical Depot, Inc. dba Drive DeVilbiss Healthcare in place of the rubber feet. The ski-like design of the Walker Ski Glides, however, creates the potential for catching lips in carpet or door thresholds when the Walker is moved in certain directions.

Therefore, there is a need for a more durable walker glide that can slide along the ground in all directions.

SUMMARY OF THE INVENTION

The present invention is directed to a durable walker ide that is configured to be placed on the rear legs of a 2-wheeled walker to allow smooth gilding along flooring surfaces in all directions.

One aspect of the present invention is to provide a walker glide comprising: a housing having a cavity member configured to receive a distal end of a leg of a walker; and a base shoe removably attached to the housing. The combination of the housing and the base shoe may form a substantially spherical shape. The attachment of the base shoe to the housing may be maintained by friction between the base shoe and the housing.

Additionally, or alternatively, the housing may further comprise a shell about the cavity member, the shell may have an inner surface and the base shoe may comprise a ridge having an outer surface; whereby the outer surface of the ridge is in frictional contact with the inner surface of the shell.

The cavity member may have a base with a through-hole, and the cavity member may have a base with a protrusion configured to contact an inside surface of the walker leg.

The base shoe may have a wear indicator, and may further comprise a glide surface and an internal structure with an internal structure surface; whereby the wear indicator is a wear hole extending from the internal structure surface toward the glide surface.

Additionally, or alternatively, the base shoe may have a base shoe central axis and the wear hole may be axially aligned with the base shoe central axis. The base shoe may also have an internal structure comprising a framework of ribs or the base shoe may have an internal structure comprising a solid fill of material.

The housing may further comprise a peripheral surface and the walker glide may further comprise a wrap provided on the peripheral surface. The wrap may be a plastic sleeve, and the plastic sleeve may be coated with a clear epoxy. The wrap may comprise at least one of a design or text.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
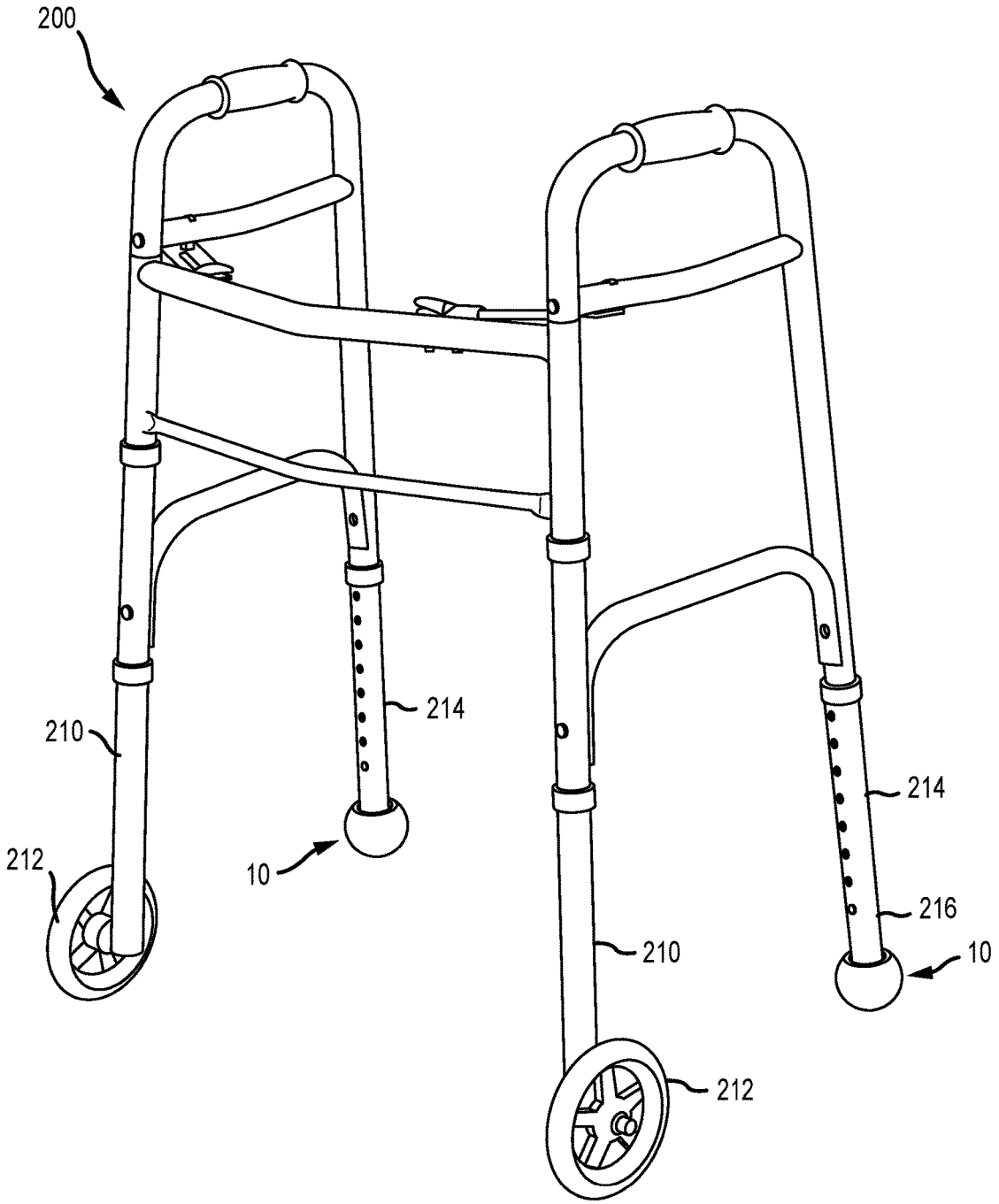
FIG. 1 is a perspective view of a Walker with a walker glide according to the present invention.

Looking to FIG. 1, a Walker 200 having a pair of front legs 210 with wheels 212 and a pair of rear legs 214 is shown. A walker glide 10 according to the present invention is shown provided on the distal end portions 216 of each of the rear legs 214.

FIGS. 2A-2C and 3 further illustrate the walker glide 10. The walker glide 10 is preferably mostly spherical in shape and comprises a housing 20 (preferably making up approximately the upper two-thirds of the walker glide 10) with a housing central axis 22 and a base shoe 80 (preferably making up approximately the lower one-third of the walker glide 10) with a base shoe central axis 82 removably affixable to the housing 20.

Both the housing 20 and the base shoe 80 preferably comprise a non-marking polymeric material. The mostly spherical shape promotes omnidirectional (meaning in any direction) movement across various surfaces and potential obstructions, for example, door jams, yet the polymeric material allows enough friction for the user to appropriately control his or her speed.

Figure 4:
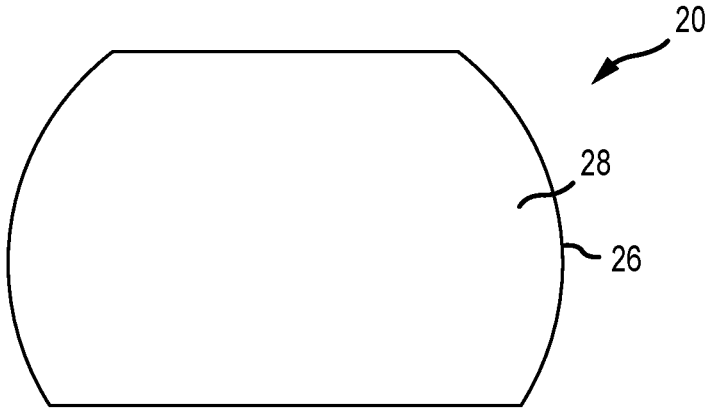
FIG. 4 is a side elevation view of a walker glide housing according to the present invention.
Figure 5:
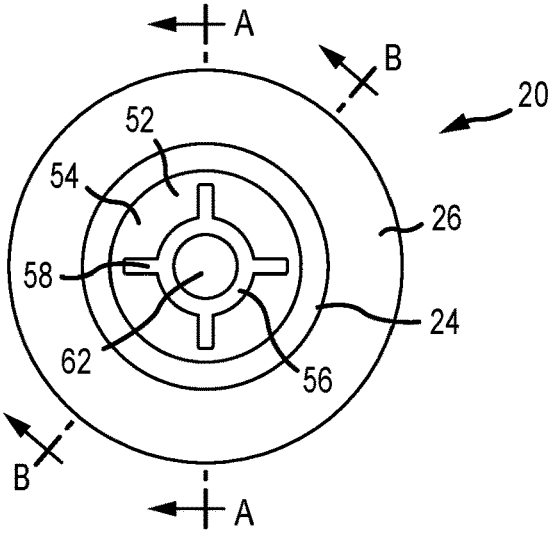
FIG. 5 is a top plan view of the walker glide housing.
Figure 5A:
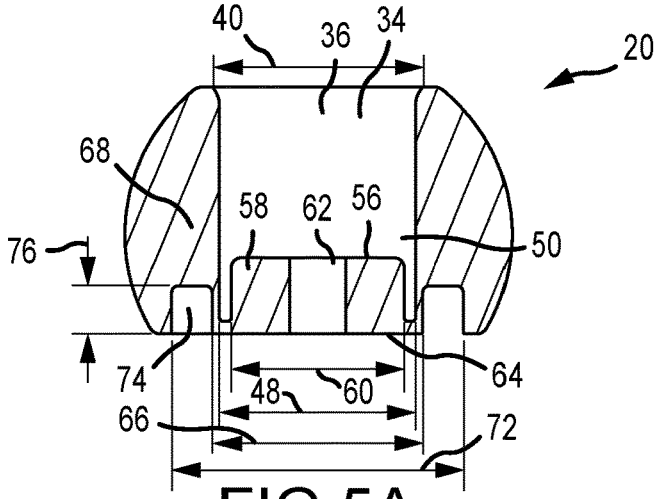
FIG. 5A is a cross-sectional view of the walker glide housing along line A-A in FIG. 5.
Figure 5B:
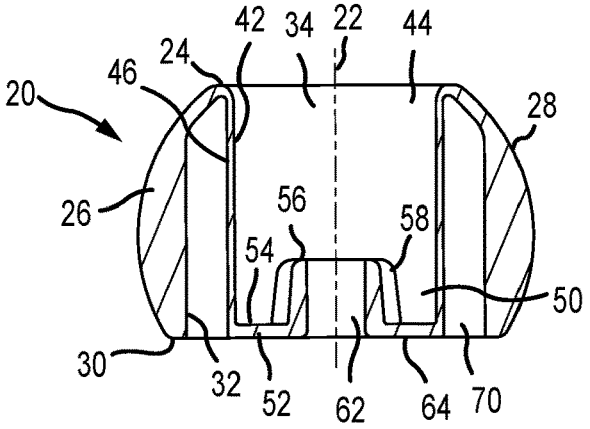
FIG. 5B is a cross-sectional view of the walker glide housing along line B-B in FIG. 5.
Figure 6:
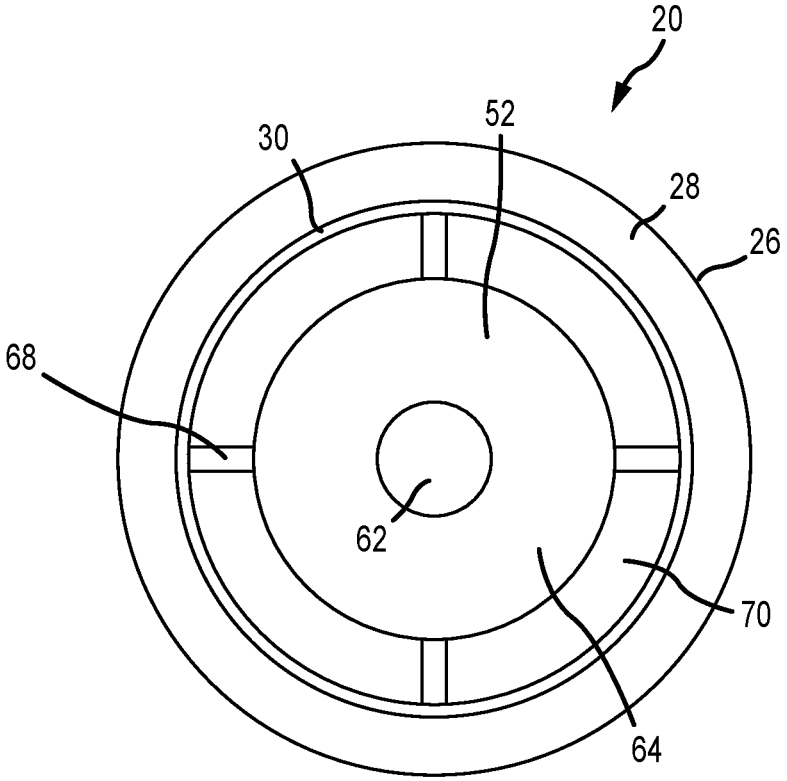
FIG. 6 is a bottom plan view of the walker glide housing.

FIGS. 4-6 illustrate an exemplary embodiment of the housing 20 according to the present invention. The housing 20 preferably comprises a shell 26, a cavity member 34, a plurality of fins 68 joining the shell 26 to and along the cavity member 34, a first surface 24 shared by the shell 26 and the cavity member 34, and a recess 70 defined by the space between the shell 26 and the cavity member 34.

The shell 26 preferably comprises a peripheral surface 28, a shell second surface 30 opposite the first surface 24, and an inner surface 32. The plurality of fins 68 extend from the first surface 24 toward the shell second surface 30 and terminate prior to reaching the shell second surface 30, creating a channel 74 in the recess 70 with a channel height 76.

The cavity member 34 is preferably cylindrical in shape and comprises a first end portion 36 and a second end portion 50 opposite the first end portion 36, a wall 42, a base 52 provided in the second end portion 50, and a cavity diameter 48. At the first end portion 36 of the cavity member 34 is an opening 38 having a cavity opening diameter 40. The wall 42 extends from the opening 38 at the first end portion 36 to the base 52 at the second end portion 50. The wall 42 has an inner surface 44 and an outer surface 46.

The base 52 comprises an inner surface 54 and an outer surface 64. The outer surface 64 is preferably substantially co-planar with the shell second surface 30 and has an outer surface diameter 66. A through-hole 62 extends through the base 52 axially aligned with the housing central axis 22.

A protrusion 56 extends from the inner surface 54 of the base 52 about the through-hole 62 and toward the first end portion 36. The protrusion 56 preferably comprises a plurality of flanges 58 with an outer flange dimension 60 which extend radially outward from the through-hole 62 toward the inner surface 44 of the wall 42.

The cavity member 34 is preferably sized and configured to receive the distal end portion 216 of the rear leg 214 of the walker 200 therein (see FIG. 1). Whereby, when installed, the distal end portion 216 of the rear leg 214 preferably contacts the inner surface 44 of the wall 42 and the inner surface 54 of the base 52, with the protrusion 56 extending within distal end portion 216 of the rear leg 214 and the flanges 58 of the base 52 making contact with the inside surface (hidden) of the rear leg 214.

Figure 7:
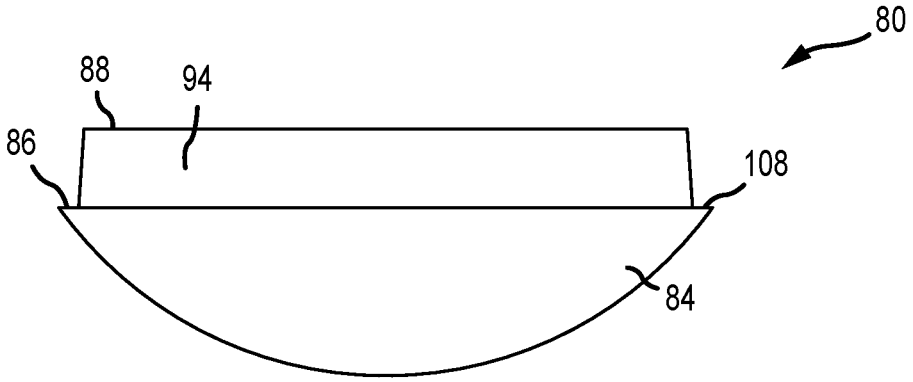
FIG. 7 is a side elevation view of a first embodiment of a walker glide base shoe according to the present invention.
Figure 8:
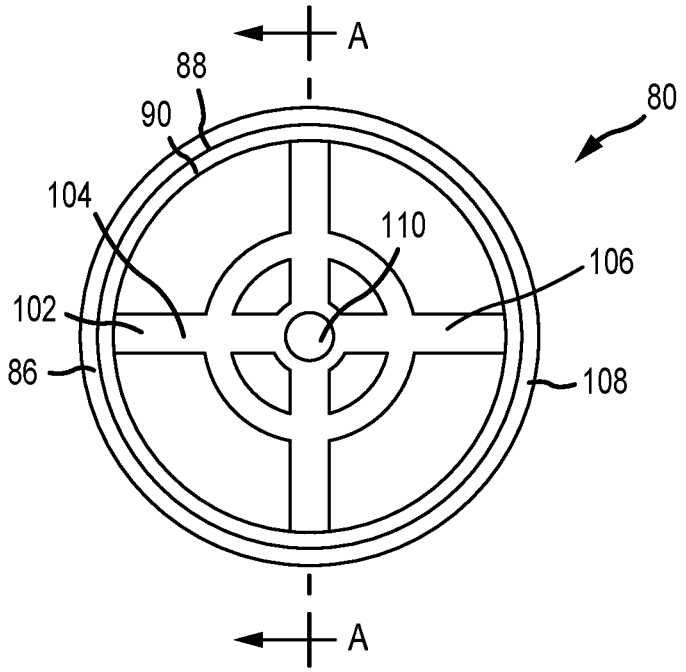
FIG. 8 is a top plan view of the first embodiment walker glide base shoe.
Figure 8A:
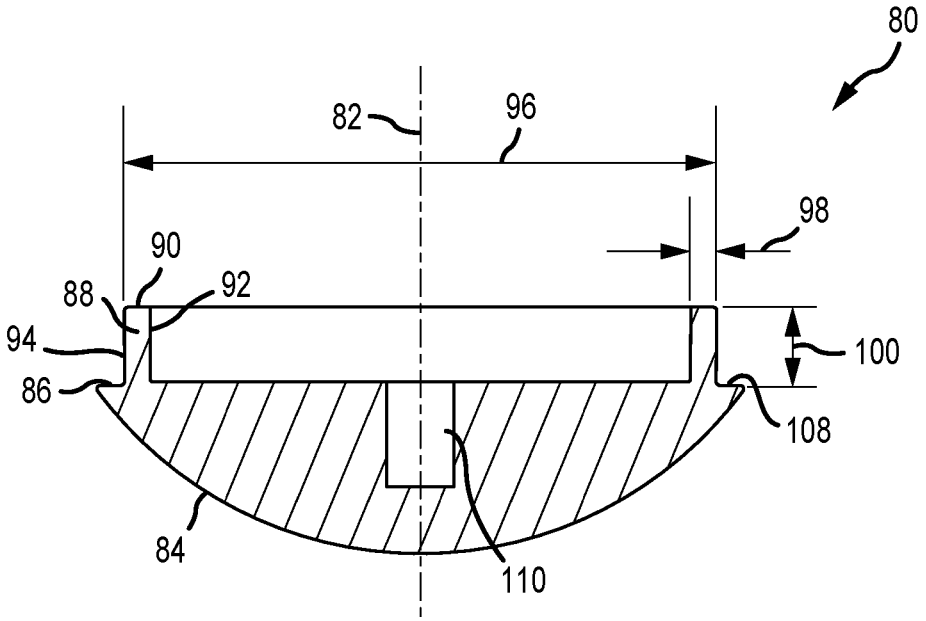
FIG. 8A is a cross-sectional view of the first embodiment walker glide base shoe along line A-A in FIG. 8.

FIGS. 7-8A illustrate an exemplary embodiment of the base shoe 80 according to the invention. The base shoe 80 preferably comprises a glide surface 84 terminating at a first surface 86, a ridge 88, an internal structure 102 having an internal structure surface 104, and a wear indicator (here shown as a wear hole 110, although other forms of wear indicators are contemplated, including but not limited to a different color or type of material).

The ridge 88 preferably comprises a top surface 90, an inner surface 92, and an outer surface 94, and has an outer ridge diameter 96, a ridge thickness 98, and a ridge height 100. The ridge 88 extends substantially perpendicular from and about the first surface 86 inward from the glide surface 84 and defines a lip 108 between the outer surface 94 of the ridge 88 and the glide surface 84. As shown in FIG. 7, it is also contemplated that the ridge 88 may be slightly tapered to aid in installation and removal of the base shoe 80 within the housing 20.

The wear hole 110 preferably extends from the internal structure surface 104 of the internal structure 102 toward the glide surface 84 and is axially aligned with the base shoe central axis 82. The wear hole 110 is configured to become visible as the glide surface 84 wears away from use, thereby providing an indication that the base shoe 80 should be replaced.

Figure 9:
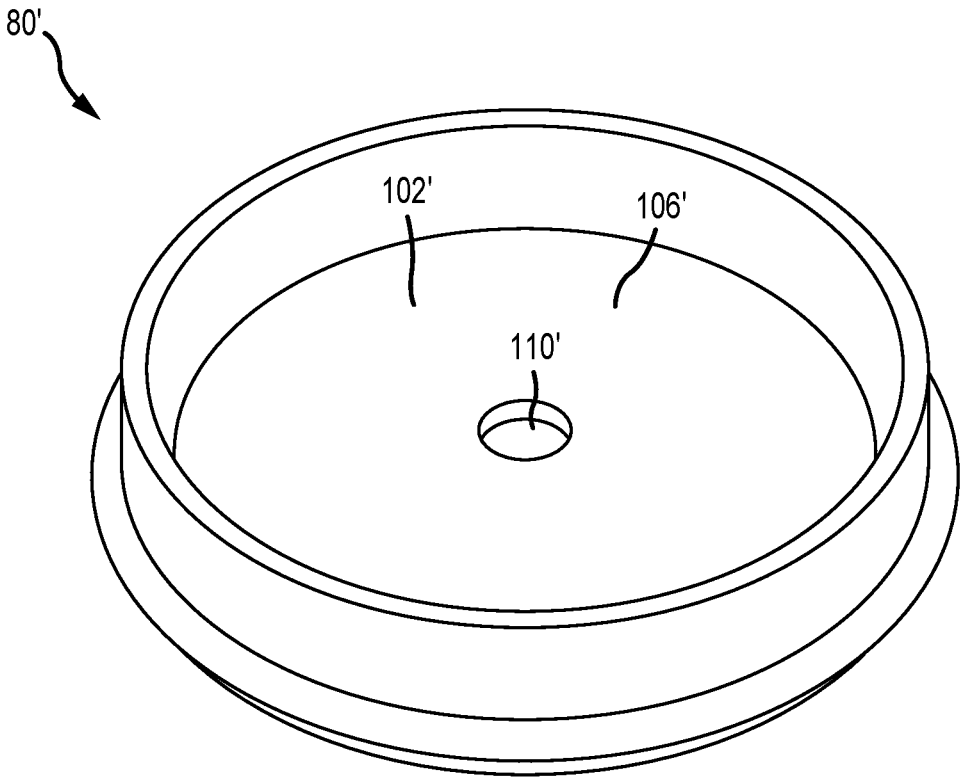
FIG. 9 is a perspective view of a second embodiment of the walker base show according to the present embodiment.

The internal structure 102 of the base shoe 80 is shown in FIG. 8 as a framework of ribs 106. Looking to FIG. 9, a second embodiment 80' of the base shoe is depicted. The internal structure 102' is comprised of a solid fill 106' of material, preferably of the same material which comprises the base shoe 80.

The housing 20 and the base shoe 80 are 10 configured to fit together and stay together through a friction fit between the inner surface 32 of the shell 26 and the outer surface 94 of the ridge 88. Also contemplated is a friction fit between the outer surface 46 of the cavity member wall 42 and the inner surface 92 of the ridge 88. It is also preferable that the ridge height 100 is approximately the same dimension as the channel height 76, so that top surface 90 of the ridge 88 makes contact with each of the plurality of fins 68. Further, it is preferable that the lip 108 makes contact with the shell second surface 30, and/or the outer surface 64 of the cavity base 52 makes contact with the internal structure surface 104 of the base shoe 80.

Preferably, the glide surface 84 of the base shoe 80 and the peripheral surface 28 of the shell 26 combine to form a substantially seamless assembly when combined.

To separate the base shoe 80 from the housing 20, a user (not shown) may insert an elongate object (not shown) through the opening 38 of the cavity member 34 and through-hole 62 in the second end portion 50, contact the base shoe 80, and apply pressure to overcome the friction force maintaining the connection between the housing 20 and the base shoe 80.

Figure 2A:
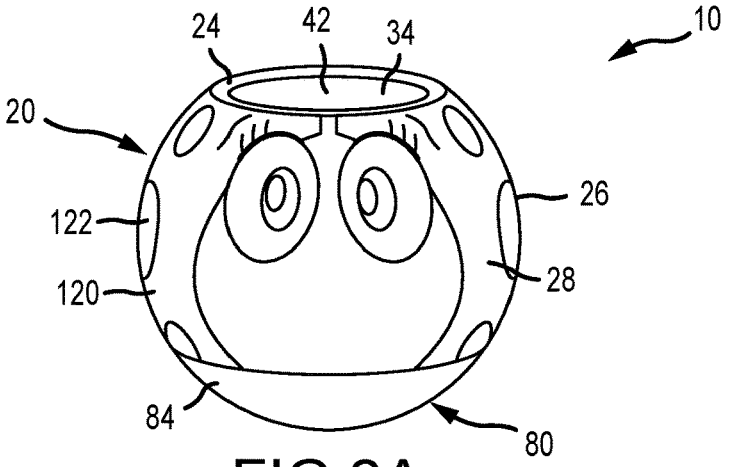
FIG. 2A is a front elevation view of a walker glide according to the present invention.
Figure 2B:
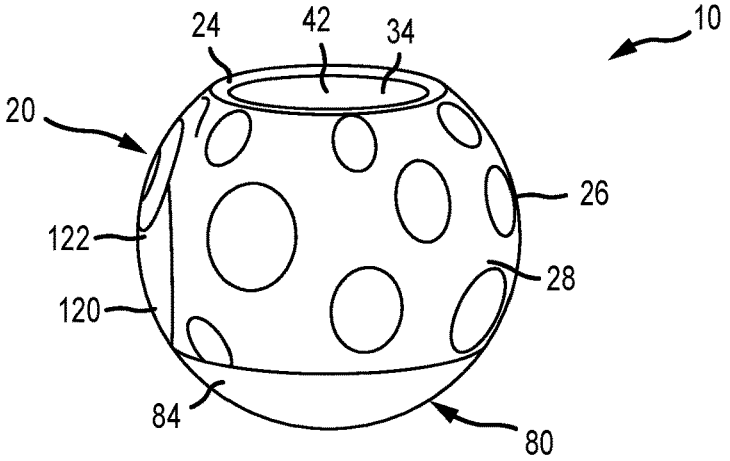
FIG. 2B is a side elevation view of the walker glide shown in FIG. 2A.
Figure 2C:
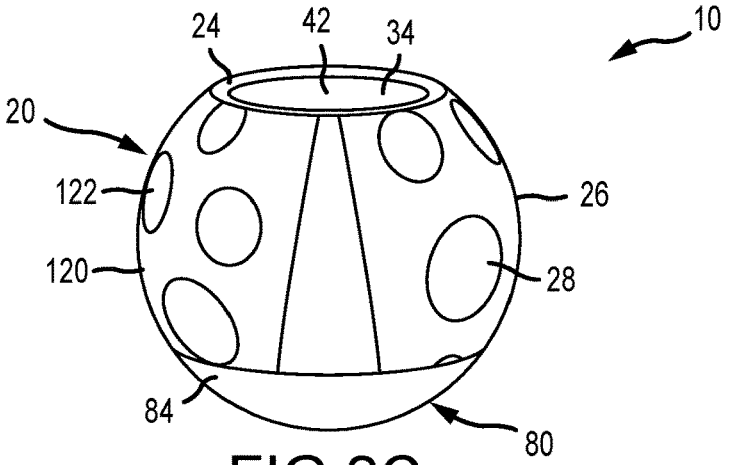
FIG. 2C is a rear elevation view of the walker glide shown if FIG. 2A.
Figure 3:
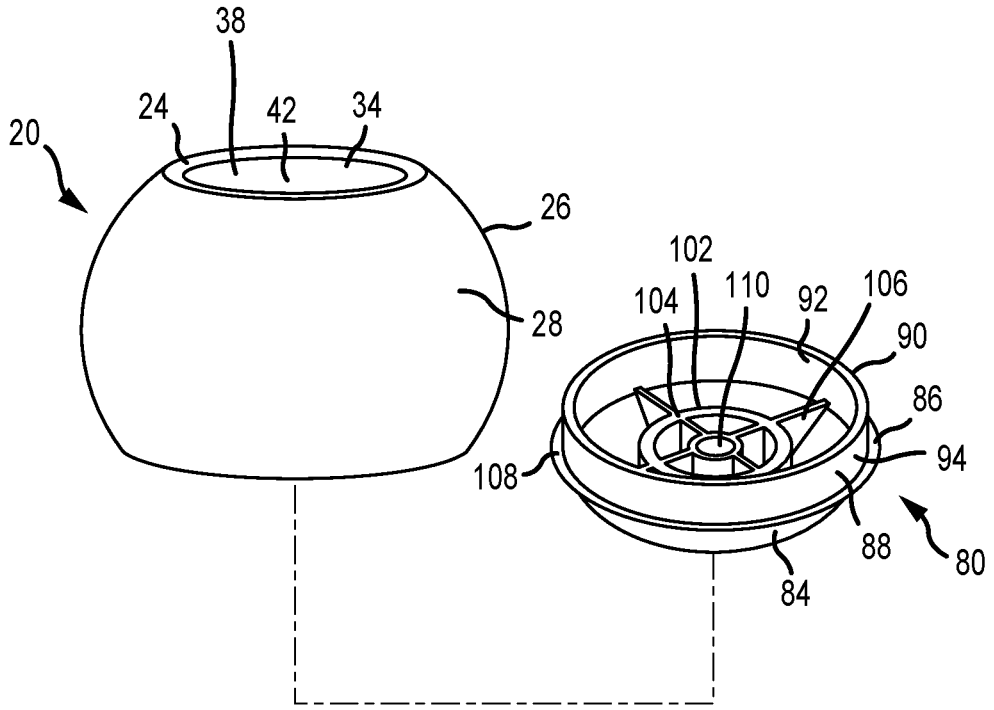
FIG. 3 is an exploded view of the walker glide.

Additionally, or alternatively, a wrap 120 (preferably formed form a shrinkable plastic sleeve) may be provided on the peripheral surface 28 of the shell 26 (see FIGS. 2A-2C). The wrap 120 is preferably a shrinkable plastic sleeve. The wrap 120 may be configured in any of a wide variety of designs and/or text 122. For example, FIGS. 2A-2C illustrate a wrap 120 with an illustration of a bug thereon. Preferably, the housing 20 with the wrap 120 is coated with a clear epoxy (not visible in the Figures) to protect the wrap 120 from damage when contacting outside objects, for example, baseboards and furniture.

The method of applying the wrap 120 comprises the steps of applying the shrinkable plastic sleeve to the housing 20, shrinking the plastic sleeve 120 to conform to the shape of the housing, and coating the plastic sleeve with a clear epoxy.

The foregoing is considered as illustrative only of the principles of the invention. Furthermore, because numerous modifications and changes will readily occur to those skilled in the art, it is not desired to limit the invention to the exact construction and operation shown and described. While the preferred embodiment has been described, the details may be changed without departing from the invention, which is defined by the claims.

The invention claimed is:

1. A walker glide comprising:

a housing with a cavity member configured to receive a distal end of a leg of a walker; and a base shoe removably attached to the housing, whereby the attachment of the base shoe to the housing is maintained by friction between the base shoe and the housing and the combination of the housing and the base shoe form a substantially spherical shape;

the cavity member having a base with an inner surface, an outer surface, a through-hole extending from the inner surface through the outer surface, and a protrusion extending from the inner surface of the base about the through-hole, whereby the inner surface of the base is configured to contact the distal end of the leg of the walker and the protrusion is configured to extend into the distal end of the leg of the walker;

the housing having a peripheral surface with a surface area and the base shoe has a glide surface with a surface area, whereby the surface area of the peripheral surface is greater than the surface area of the glide surface;

a shell extending about the cavity member, the shell having an inner surface; and the base shoe comprising a ridge having an outer surface;

whereby the outer surface of the ridge is in frictional contact with the inner surface of the shell.

2. The walker glide of claim 1, wherein the base shoe has a wear indicator.

3. The walker glide of claim 2, wherein the base shoe further comprises an internal structure with an internal structure surface; and whereby the wear indicator is a wear hole extending from the internal structure surface toward the glide surface.

4. The walker glide of claim 3, wherein the base shoe has a base shoe central axis and the wear hole is axially aligned with the base shoe central axis.

5. The walker glide of claim 1, wherein the base shoe has an internal structure comprising a framework of ribs.

6. The walker glide of claim 1, wherein the base shoe has an internal structure comprising a solid fill of material.

7. A walker glide comprising:

a housing with a cavity member configured to receive a distal end of a leg of a walker; and a base shoe removably attached to the housing, whereby the combination of the housing and the base shoe form a substantially spherical shape;

the cavity member having a base with an inner surface, an outer surface, a through-hole extending from the inner surface through the outer surface, and a protrusion extending from the inner surface of the base about the through-hole, whereby the inner surface of the base is configured to contact the distal end of the leg of the walker and the protrusion is configured to extend into the distal end of the leg of the walker;

the housing having a peripheral surface with a surface area and the base shoe has a glide surface with a surface area, whereby the surface area of the peripheral surface is greater than the surface area of the glide surface; and a wrap provided on the peripheral surface.

8. The walker glide of claim 7, wherein the wrap is a plastic sleeve.

9. The walker glide of claim 8, wherein the plastic sleeve is coated with a clear epoxy.

10. The walker glide of claim 7, wherein the wrap comprises at least one of a design or text.

* * * * *